US006224337B1

(12) United States Patent
Lieland et al.

(10) Patent No.: US 6,224,337 B1
(45) Date of Patent: May 1, 2001

(54) THERMAL BARRIER COATED SQUEALER TIP CAVITY

(75) Inventors: Kenneth M. Lieland; Robert W. Harris, both of Cincinnati, OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/399,195

(22) Filed: Sep. 17, 1999

(51) Int. Cl.[7] ..... F01D 5/18

(52) U.S. Cl. ..... 416/97 R; 416/224; 416/241 B; 415/173.4

(58) Field of Search ..... 416/97 R, 241 R, 416/241 A, 241 B, 224; 415/173.4

(56) References Cited

U.S. PATENT DOCUMENTS 4,247,254 1/1981 Zelahy .
4,743,462 5/1988 Redzavich et al. .
5,271,715 * 12/1993 Zelesky et al. ..... 416/97 R
5,620,307 4/1997 Mannava et al. .
5,733,102 3/1998 Lee et al. .
5,794,338 8/1998 Bowden, Jr. et al. .
5,813,836 9/1998 Starkweather .
5,846,057 12/1998 Ferrigno et al. .

* cited by examiner

*Primary Examiner*—Christopher Verdier
(74) *Attorney, Agent, or Firm*—Andrew C. Hess; Rodney M. Young

(57) ABSTRACT

A turbine blade squealer tip includes an airfoil shaped tip cap having a squealer tip wall extending radially outwardly from and around the perimeter of the airfoil shaped tip cap to define a radially outwardly open tip cavity. The tip wall has an inboard side facing the interior of the cavity and an outboard side facing away from the cavity and the tip cap has an outer tip side on a bottom of the cavity. Thermal barrier coatings are disposed on the inboard and outboard sides of the squealer tip wall and on the outer tip side of the tip cap. One embodiment provides the tip cap with cooling holes disposed therethrough to flow cooling air into the cavity.

8 Claims, 3 Drawing Sheets

THERMAL BARRIER COATED SQUEALER TIP CAVITY

BACKGROUND OF THE INVENTION

1. Field of the Invention

The present invention relates generally to gas turbine engine turbine blade tip cooling and, more specifically, to a turbine blade tip coated with thermal barrier.

2. Description of Related Art

A gas turbine engine turbine blades extract energy from hot combustion gas for powering the compressor and providing output power. Since the turbine blades are directly exposed to the hot combustion gas, they are typically provided with internal cooling circuits which channel a coolant, such as compressor bleed air, through the airfoil of the blade and through various film cooling holes around the surface thereof.

One type of airfoil extends from a root at a blade platform, which defines the radially inner flowpath for the combustion gas, to a radially outer tip cap, and includes opposite pressure and suction sides extending axially from leading to trailing edges of the airfoil. The cooling circuit extends inside the airfoil between the pressure and suction sides and is bounded at its top by the airfoil tip cap. A squealer tip blade has a squealer tip wall extending radially outwardly from the top of the tip cap and around the perimeter of the airfoil on the tip cap to define a radially outwardly open tip cavity.

The squealer tip is a short radial extension of the airfoil wall and is spaced radially closely adjacent to an outer turbine shroud to provide a relatively small clearance gap therebetween for gas flowpath sealing purposes. Differential thermal expansion between the blade and the shroud, centrifugal loading, and radial accelerations cause the squealer tips to rub against the turbine shroud and abrade. Since the squealer tips extend radially above the tip cap, the tip cap itself and the remainder of the airfoil is protected from damage, which maintains integrity of the turbine blade and the cooling circuit therein.

However, since the squealer tips are solid metal projections of the airfoil, they are directly heated by the combustion gas which flows thereover. They are cooled by heat conduction with the heat then being removed by convection into the tip cap and cooling air injected into the cavity by passages through the tip. The cooling air from within the airfoil cooling circuit is used to convect heat away from tip and to inject into cavity. The squealer tip typically operates at temperatures above that of the remainder of the airfoil and can be a life limiting element of the airfoil in a hot turbine environment.

Thermal barrier coatings (TBC) are well known and proven as thermal insulators used at various locations in gas turbine engines. However, TBC is effective only at locations in the engine where heat flux is high due to differential temperature between hot and cold sides of a component. Since a typical squealer tip is directly bathed on both its inboard and outboard sides in the hot turbine flowpath gas, it has a relatively low heat flux laterally therethrough which decreases the effectiveness of TBC applied on the outboard side thereof.

Since the pressure side of an airfoil typically experiences the highest heat load from the combustion gas, a row of conventional film cooling holes is typically provided in the pressure side of the airfoil outer wall immediately below the tip cap for providing a cooling film which flows upwardly over the pressure side of the squealer tip. Although this enhances cooling of the pressure side squealer tip, it also effects a relatively large radial temperature gradient from the top of the squealer tip down to the tip cap near the film cooling holes. A large temperature gradient in this direction creates thermal stress which over repeated cycles of operation of the engine may lead to metal cracking that limits the effective life of the blade.

In order to reduce this undesirable radial thermal gradient in the squealer tips, the blade tips have been masked during the TBC coating process to eliminate TBC along the outboard side of the squealer tip, while maintaining TBC over the remainder of the outer surface of the outer wall of the airfoil. The entire squealer tip, in such a blade, is operated without TBC protection to reduce the undesirable radial temperature gradient. However, the masking process in the manufacture of the turbine blades significantly increases the cost of manufacture which is undesirable.

U.S. Pat. No. 5,733,102, entitled "Slot Cooled Blade Tip", discloses a slot extending radially inwardly to the tip cap and along the pressure squealer tip between leading and trailing edges of the airfoil. A plurality of spaced apart supply holes extend radially through the tip cap from the slot to the cooling circuit for channeling the coolant into the slot for cooling the squealer tip. A thermal barrier coating is disposed on an outboard side of the squealer tip for providing insulation against the hot gas that flows therealong. The construction of the turbine blade squealer tip in U.S. Pat. No. 5,733,102, is to eliminate the masking process, while still providing effective cooling of blade squealer tips, when used in conjunction with TBC.

TBC has not been used inside the tip cap cavities of rotating airfoils because of concerns that the thermal gradient from the top of the squealer tip to the tip cap area will be increased (cooler tip cap) which in turn would cause an increase in the stresses that generate commonly occurring squealer tip cracks. Squealer tip wall cracks occur due to operational environment and it is desirable to prevent them from propagating into the tip cap and also to lower tip cap operating temperature to improve material properties. The squealer tip cracking eventually begins to propagate across the tip cap or plenum. Several tip cap cracks propagate and join together in the tip cap resulting in the liberation of a portion of the tip cap. The missing tip cap portion "short circuits" the airfoil cooling circuit resulting in premature distress to the area of the airfoil receiving little to no cooling air. The squealer tip and tip cap cracking would most likely cause more complicated weld repairs to be performed at the blade service shops. These more complicated weld repairs result in increased losses at the engine overhaul level and more expensive blade repairs which both adversely impact the maintenance costs per flight hour of the engine. It is desirable to prevent tip crack propagation and avoid these costly weld repairs.

SUMMARY OF THE INVENTION

A turbine blade squealer tip includes an airfoil shaped tip cap having a squealer tip wall extending radially outwardly from and around the perimeter of the airfoil shaped tip cap to define a radially outwardly open tip cavity. The tip wall has an inboard side facing the interior of the cavity and an outboard side facing away from the cavity and the tip cap has an outer tip side on a bottom of the cavity. Thermal barrier coatings are disposed on the inboard and outboard sides of the squealer tip wall and on the outer tip side of the tip cap. One embodiment provides the tip cap with cooling holes disposed therethrough to flow cooling air into the cavity. Radially outwardly angled shaped cooling holes are disposed through at least the pressure side of the airfoil immediately below the tip cap for flowing cooling air radially outwardly along an outboard side of squealer tip wall.

ADVANTAGES

Advantages of the present invention are numerous and include lowering the cost, time, man power and complexity of maintaining the turbine blades in operating condition. The present invention lowers the operating temperature of the turbine blade squealer tip cap and inhibits propagation of turbine squealer tip wall cracks from propagating into the tip cap. This prevents premature coalition of the tip cap cracks that would liberate parts of the tip cap leading to a turbine blade failure.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
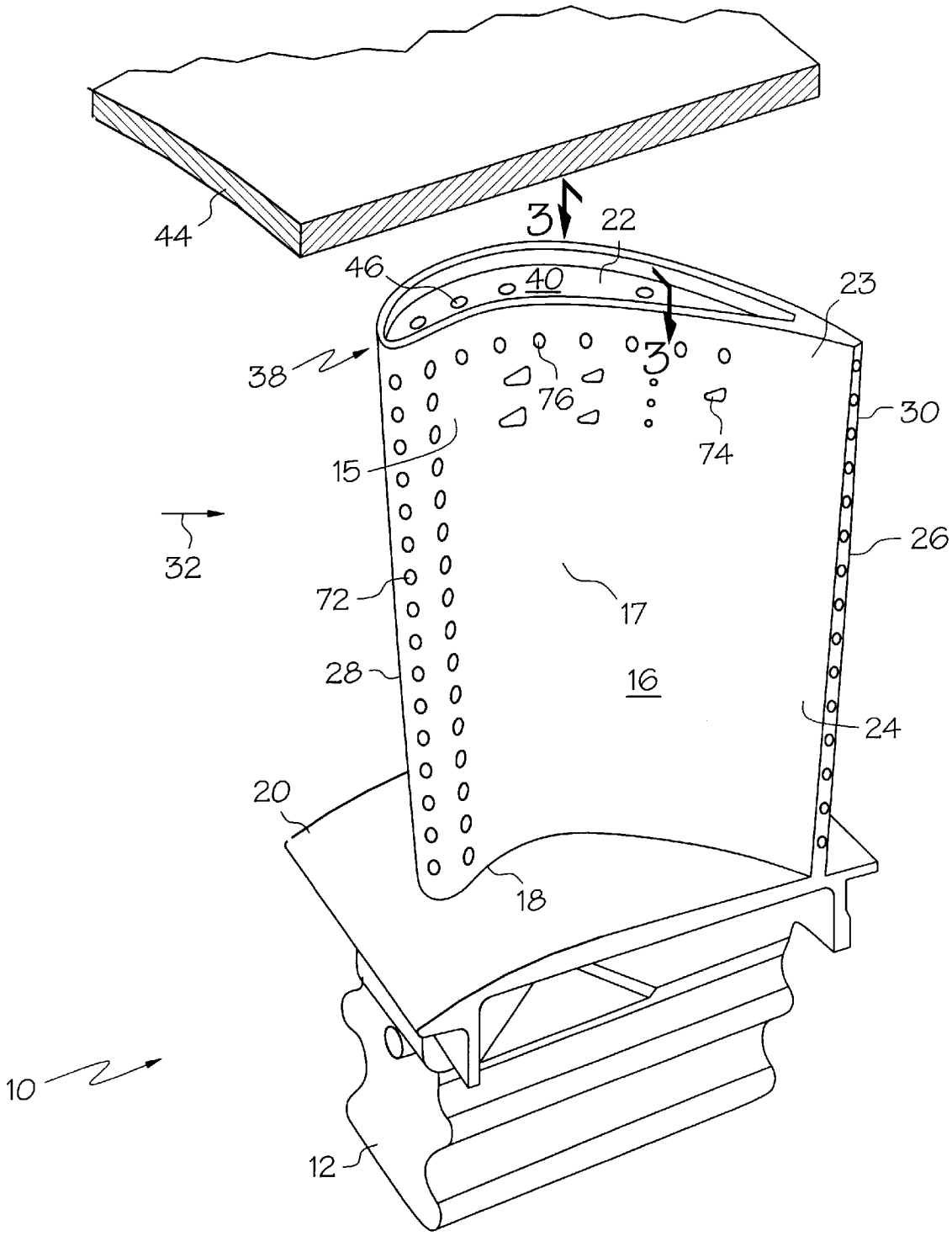
FIG. 1 is an isometric illustration of an exemplary gas turbine engine turbine blade having a cooled airfoil and a squealer blade tip with thermal barrier coatings on interior surfaces and exterior of the squealer tip.
Figure 2:
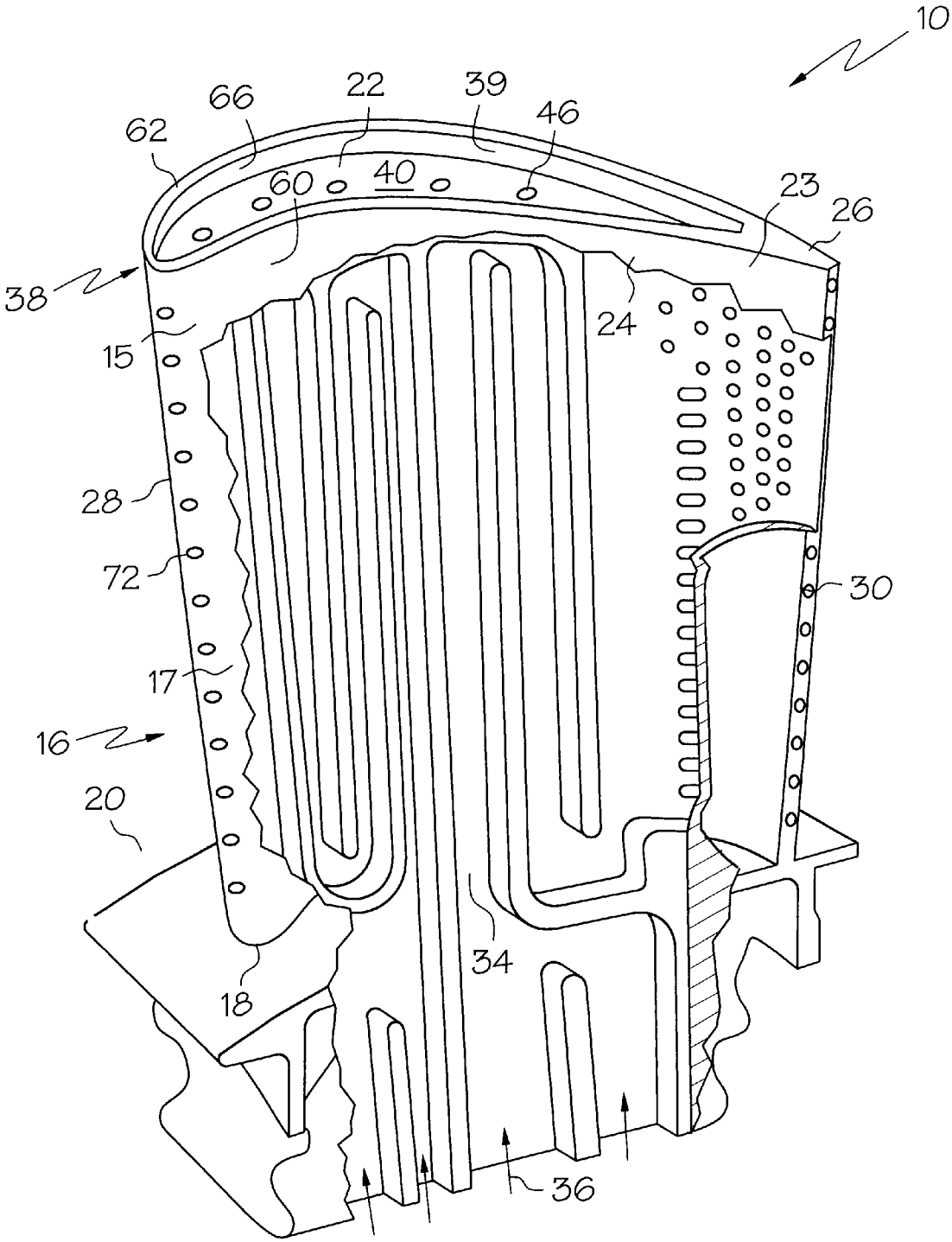
FIG. 2 is a partial cut-away illustration of the gas turbine engine turbine blade in FIG. 1.

Illustrated in FIGS. 1 and 2 is an exemplary gas turbine engine turbine rotor blade 10 configured for use as a first stage high pressure turbine blade. The blade 10 includes a conventional dovetail 12 having suitable tangs for mounting the blade in corresponding dovetail slots in the perimeter of a rotor disk (not shown). The blade 10 further includes an airfoil 16 having a root 18 joined to the dovetail 12, an integral platform 20, and a radially opposite squealer tip 38 at a radially outer end 23 of the airfoil. The squealer tip 38 includes an airfoil shaped squealer tip cap 22. The airfoil 16 also includes an outer wall 15 with laterally opposite pressure and suction sides 24 and 26, respectively, extending between a leading edge 28 and an opposite trailing edge 30 from the root to the tip cap 22 and, over which is flowable a hot flowpath gas 32.

The airfoil 16 further includes an internal cooling channel or circuit 34 which extends from the tip cap 22 to the root and through the dovetail 12 for circulating or channeling a suitable coolant 36, such as air which may be bled from a conventional compressor (not shown) for cooling the blade 10. The internal cooling channel or circuit 34 is radially outwardly bound by tip cap 22.

Except as further described hereinbelow, the blade 10 may have any conventional configuration and is typically formed as a one-piece casting of the dovetail 12, airfoil 16, and platform 20 of a suitable high temperature metal such as nickel-based superalloys in a single crystal configuration which enjoys suitable strength at high temperature operation.

The squealer tip 38 includes a squealer tip wall 39 extending radially outwardly from and entirely around the airfoil shaped tip cap 22 along the pressure and suction sides 24 and 26, respectively, of the airfoil 16 and having a height H as measured from the tip cap. The squealer tip wall 39 and tip cap 22 may be integrally formed or cast with the airfoil or be brazed or welded or otherwise attached to the airfoil. The squealer tip wall 39 extends around the tip cap 22 between laterally apart leading and trailing edges 28 and 30, respectively, of the airfoil 16 to define a radially outwardly open tip cavity 40.

An external surface 17 of the outer wall 15 of airfoil 16 is film cooled by flowing cooling air through leading edge shower head cooling holes 72 and downstream angled film cooling holes 74 along the outer wall 15. Radially outwardly angled shaped cooling holes 76 are disposed through at least the pressure side 24 of the airfoil 16 immediately below the tip cap 22 for flowing cooling air radially outwardly along an outboard side 60 of squealer tip wall 39.

The squealer tip wall 39 typically includes a flat top 62 for conventional use in providing a relatively small radial gap G between the tip wall and a conventional turbine shroud 44 for reducing leakage of the flowpath gas 32 therebetween during operation. During portions of the engines's operation, the squealer tip wall 39 will rub against the shroud 44 protecting the remainder of the airfoil 16 and tip cap 22 from damage. This will cause an acceptable and planned amount of cracking in the tip wall 39 which is periodically replaced during overhauls. A plurality of chordally spaced apart tip cap supply holes 46 extend radially through the tip cap 22 in flow communication with the cooling circuit 34 inside the airfoil 16 for channeling respective portions of the coolant 36 therefrom and into the tip cavity 40 for cooling the tip, the cavity, and inboard side 66 of the tip wall 39 by convection.

Figure 3:
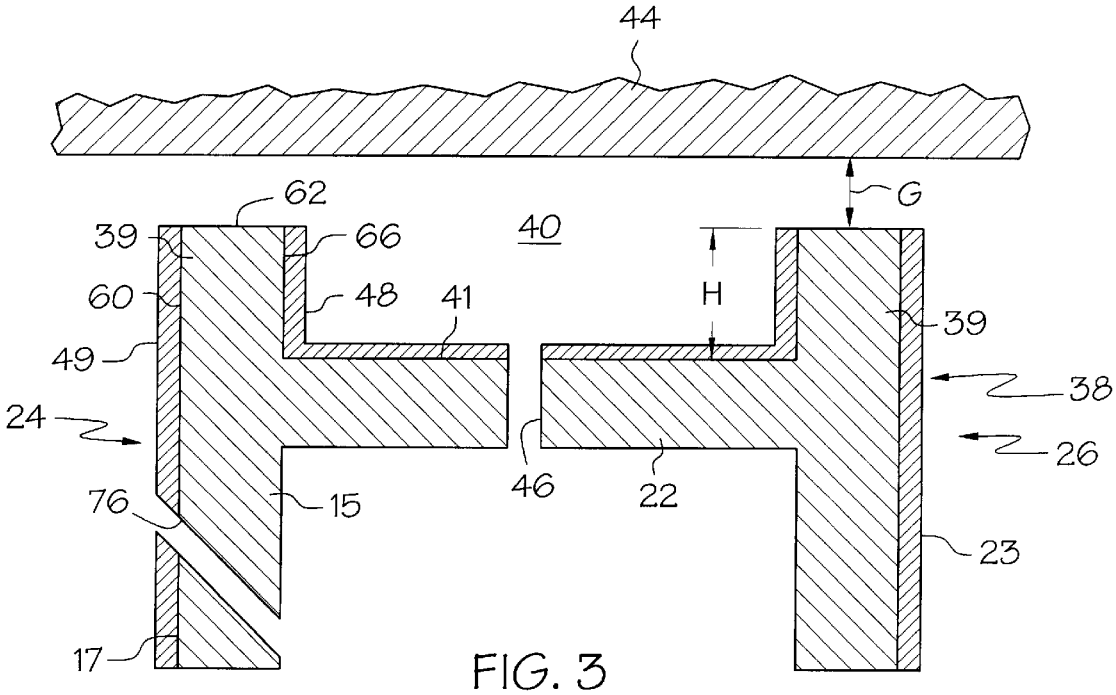
FIG. 3 is a cross-sectional view through the blade tip illustrated in FIG. 1 and taken generally along line 3—3.

Illustrated in FIG. 3 is a first thermal barrier coating (TBC) 48 applied over the entire inner surface bounding the tip cavity 40 along inboard side 66 of the squealer tip wall 39 and on a radially outwardly facing surface 41 of the tip cap 22. A second thermal barrier coating 49 is applied over the outboard side 60 and and the external surface 17 of the airfoil 16 along both the pressure and suction sides 24 and 26, respectively, from the root 18 to the squealer tip 38. The flat top 62 is bare of either the first thermal barrier coating 48 the second thermal barrier coating 49 and does not have any thermal barrier coating. This provides a desirable temperature gradient across the respective walls and the tip cap. The TBC coatings may take any conventional composition, such as zirconia, which is a thermally insulating ceramic material. Though the TBC coating of the inboard and outboard sides 66 and 60, respectively, and of the tip cap 22 prevents a relatively large lateral thermal gradient in the squealer tip 38, it does inhibit cracks formed in the tip wall 39 from progressing into the tip cap where it can coalesce to liberate portions of the tip cap.

While the preferred embodiment of the present invention has been described fully in order to explain its principles, it is understood that various modifications or alterations may be made to the preferred embodiment without departing from the scope of the invention as set forth in the appended claims.

We claim:

1. A turbine blade squealer tip comprising:

a tip cap, a squealer tip wall extending radially outwardly from said tip cap forming a radially outwardly open tip cavity, a first thermal barrier coating disposed on a radially outwardly facing side of said tip cap and on an inboard side of said squealer tip wall, and a flat top on said squealer tip wall, said flat top bare of any thermal barrier coating.

2. A turbine blade squealer tip as claimed in claim 1 further comprising a second thermal tip coating on an outboard side of said squealer tip wall.

3. A turbine blade squealer tip as claimed in claim 2 further comprising at least one tip cap coolant supply hole extending through said tip cap to said cavity.

4. A turbine blade comprising:

an airfoil including an airfoil outer wall and a squealer tip at a radially outer end of said airfoil outer wall, said squealer tip including a radially outer tip cap attached to said airfoil outer wall, a squealer tip wall extending radially outwardly from said tip cap forming a radially outwardly open tip cavity, a first thermal barrier coating disposed on a radially outwardly facing side of said tip cap and on an inboard side of said squealer tip wall, and a flat top on said squealer tip wall, said flat top bare of any thermal barrier coating.

5. A turbine blade as claimed in claim 4 further comprising a second thermal tip coating on an outboard side of said squealer tip wall.

6. A turbine blade as claimed in claim 5 further comprising an internal cooling circuit inside of said airfoil and at least one tip cap supply hole extending radially through said tip cap to said cavity and in fluid flow communication with said cooling circuit.

7. A turbine blade as claimed in claim 6 her comprising radially outwardly angled shaped cooling holes disposed through at least a pressure side of said airfoil wall immediately radially inwardly of said tip cap for flowing cooling air radially outwardly along said outboard side of said squealer tip wall, said cooling holes being in fluid flow communication with said cooling circuit.

8. A turbine blade as claimed in claim 7 wherein said second thermal tip coating extends all over the external surface of said airfoil wall.

* * * * *